US005283554A

United States Patent [19]

Edelson et al.

[11] Patent Number: 5,283,554

[45] Date of Patent: Feb. 1, 1994

[54] MODE SWITCHING SYSTEM FOR A PIXEL BASED DISPLAY UNIT

[75] Inventors: Steven D. Edelson, Wayland; Lawrence Bodony, Waban, both of Mass.

[73] Assignee: Analog Devices, Inc., Norwood, Mass.

[21] Appl. No.: 482,068

[22] Filed: Feb. 21, 1990

[51] Int. Cl.[5] ..... G09G 1/28

[52] U.S. Cl. ..... 345/153; 345/155; 345/186

[58] Field of Search ..... 340/703, 228, 744, 799, 340/750, 747, 721, 748, 701

[56] References Cited

U.S. PATENT DOCUMENTS

| | | | |
|---|---|---|---|
| 4,704,605 | 11/1987 | Edelson | 340/728 |
| 4,772,881 | 9/1988 | Hannash | 340/703 |
| 4,799,053 | 1/1989 | Van Aken et al. | 340/703 |
| 4,818,979 | 4/1989 | Manson | 340/703 |
| 4,819,234 | 4/1989 | Huber . | |
| 4,843,380 | 6/1989 | Oakley et al. | 340/728 |
| 4,857,901 | 8/1989 | Lathrop | 340/703 |
| 5,038,300 | 8/1991 | Seiler | 340/703 |

OTHER PUBLICATIONS

*inmos*, "IMS G300 Colour Video Controller", 1988, pp. 73–85.

*Primary Examiner*—Alvin E. Oberley
*Assistant Examiner*—Xiao M. Wu
*Attorney, Agent, or Firm*—Lane, Aitken & McCann

[57] ABSTRACT

In a pixel display system, a plug-to-plug compatible pixel decoder palette is provided which is responsive to a predetermined sequence of commands on an I/O data channel to switch the mode of operation of the pixel decoder palette. The pixel coder palette comprises a random access memory used as a look-up table to store colors to be displayed and the I/O channel is used to store new colors in or read colors out from the random access memory. The different modes of operation of the pixel decoder palette involve operating on intensity values represented by 6-bit bytes and 8-bit bytes and involve continuous edge graphics wherein pixels bridging boundaries between objects are displayed as mixes of the colors on each side of the boundary.

15 Claims, 5 Drawing Sheets

MODE SWITCHING SYSTEM FOR A PIXEL BASED DISPLAY UNIT

This invention relates to pixel based color display systems and more particularly to a system of switching the mode of operation of a pixel based display system using available input data and signal lines.

BACKGROUND OF THE INVENTION

In pixel based display systems, a display screen is divided into incremental components called pixels and the display of a color image is controlled by controlling the color of each pixel in the display. State of the art pixel display systems make use of a random access memory called a palette RAM as a look up table storing in its address locations different possible colors to be displayed in each of the pixels in the display device. Each location in the palette RAM will store three binary bytes representing a color. For example, the three bytes may represent the red, green and blue intensity components of the color. Alternatively, the three binary bytes may represent the color by values representing hue, brightness, and saturation or in the YIG color representing system. To cause a given pixel to be displayed with a selected color, the storage location in the palette RAM containing the color must be read out causing the stored bytes to be applied to digital-to-analog converters converting the color values to analog signals which become video signals. The palette RAM is part of a pixel decoder palette, also known as a RAMDAC, which receives pixel words representing palette RAM addresses in sequence, reads the color information out from the address locations selected by the received addresses, and converts the output signals read out from the palette RAM to the video signals to be applied to the video display device. In a state of the art system, the pixel decoder palette or RAMDAC is implemented in a single semiconductor chip.

In pixel based display systems, it is desirable to be able to switch the mode of operation of the pixel decoder palette from one mode of operation to another. For example, some pixel decoder palettes employ RAMS with each address location being operable to store 6-bit bytes representing color values. Other pixel decoder palettes employ palette RAMS each capable of storing 8-bit bytes. As a result, some of the pixel software, which is available to be used uses 6-bit color bytes and other pixel software makes use of 8-bit color bytes. Since the 6-bit pixel software is available to be used, it is desirable in systems having an 8-bit palette RAM to be able to switch the RAM to operate in response to either 6-bit data or 8-bit data.

In conventional pixel display systems, each pixel displayed must be one of the colors selected from the palette RAM. As a result, the edge of any object being displayed must always be displayed as occurring at the boundary between pixels. When an object edge is in the form of a diagonal line extending across the display screen, the object will appear distorted as a stair step or jagged edge. The eye is particularly sensitive to such stair step distortion and even when a large number of pixels are used to represent an object, the eye will perceive a diagonal line as a jagged edge. This artifact of pixel based displays is called aliasing.

U.S. Pat. No. 4,704,605 issued Nov. 3, 1987 to Steven D. Edelson, a coinventor of this application, discloses a system for smoothing the edges forming the boundaries between objects in pixel based displays to minimize the effect of aliasing. As described in this patent, each pixel through which a boundary or edge passes is controlled to display a color which effectively mixes the colors on each side of the boundary in amounts corresponding to where in the pixel the boundary occurs. By mixing the boundary or edge bridging pixels in this manner, the jaggedness of the edge as perceived by the viewer is substantially minimized. This method of reducing aliasing is referred to as continuous edge graphics. When a continuous edge graphics capability is provided, it is desirable to be able to switch between a conventional pixel display mode and a continuous edge graphics mode of operation.

SUMMARY OF THE INVENTION

The present invention provides a plug to plug compatible replacement part for the pixel decoder palette which can be switched between modes of operation, e.g., between a 6-bit color byte mode and an 8-bit color byte mode or into a continuous edge graphics mode. The replacement part like the pixel decoder palette that it replaces is a single semiconductor chip. Thus, the present invention provides a pixel decoder palette or RAMDAC with continuous edge graphics incorporated into the semiconductor chip comprising the pixel decoder palette. The current pixel decoder palettes do not have any extra signal line inputs to provide a means of switching the operating mode of the pixel decoder palette. In accordance with the present invention, the mode switching is achieved by a long sequence of commands to existing input signal lines to the pixel decoder palette to achieve the desired mode switching, which sequence is not used in the control of a conventional pixel decoder palette. The long sequence of commands also serves as a means to get information into the chip to be used in different operating modes.

In a conventional pixel display system, the pixel decoder palette interfaces with a digital processor, via a pixel word channel, and an I/O channel. Pixel words representing address locations in the palette RAM are applied in sequence over the pixel word channel to cause a pixel display to be generated. The I/O channel is used to load selected colors into the different memory locations in the palette RAM. Also the colors stored in a given memory location can be read out onto the I/O channel. The applicant's invention makes use of an unused sequence of commands on the I/O channel to switch the modes of operation of the pixel decoder palette.

In a conventional pixel display system, to read out data from the palette RAM onto the I/O channel, a read addressing command is first applied to the I/O channel. In the read addressing command, an address is applied to the I/O channel along with signals indicating that the address is to be used to read out the color at the specified address. The read addressing command is followed by read color commands represented by signals causing the three color bytes read from the address location in the palette RAM selected by the address to be transmitted on the I/O channel to the digital processor. The system of the present invention is described as using the color representation system in which each color is represented by red, green, and blue intensity values. Thus, the color bytes stored in a given memory location of the palette RAM represent red, green, and blue intensity values. The invention is equally applicable to the other known color representation systems.

To store a new color in a selected address location, a write addressing command is first applied to the I/O channel. In the write addressing command, the address of the selected location is applied to the I/O channel along with signals indicating that the address is to be used to store a new color in the palette RAM. The write addressing command is followed by three write color commands in sequence containing data bytes representing the red, green and blue intensity values, respectively, of the new color being stored. Each write color command includes appropriate signals indicating that the data byte is a value to be stored in the palette RAM.

In accordance with the present invention, the series of commands to switch modes comprises a read addressing command in which a predetermined palette RAM address is applied to the I/O channel followed by three successive write color commands in which predetermined data values are applied to the I/O channel. This sequence of a read addressing command followed by write color commands is conventionally incorrect and is not used in a conventional pixel display system. The conventionally incorrect sequence of commands is repeated three times, but with different predetermined data bytes following the commands containing the RAM addresses. In the third sequence, the last data value applied to the I/O channel is an information byte and contains the identification of the mode into which the pixel decoder palette is being set. Logic is provided to recognize this specific sequence of commands and switch the system into the selected mode.

The particular mode in which the pixel decoder palette is set will be stored as the blue color byte in a selected memory location in the palette RAM.

DESCRIPTION OF THE PREFERRED EMBODIMENT

Figure 1:
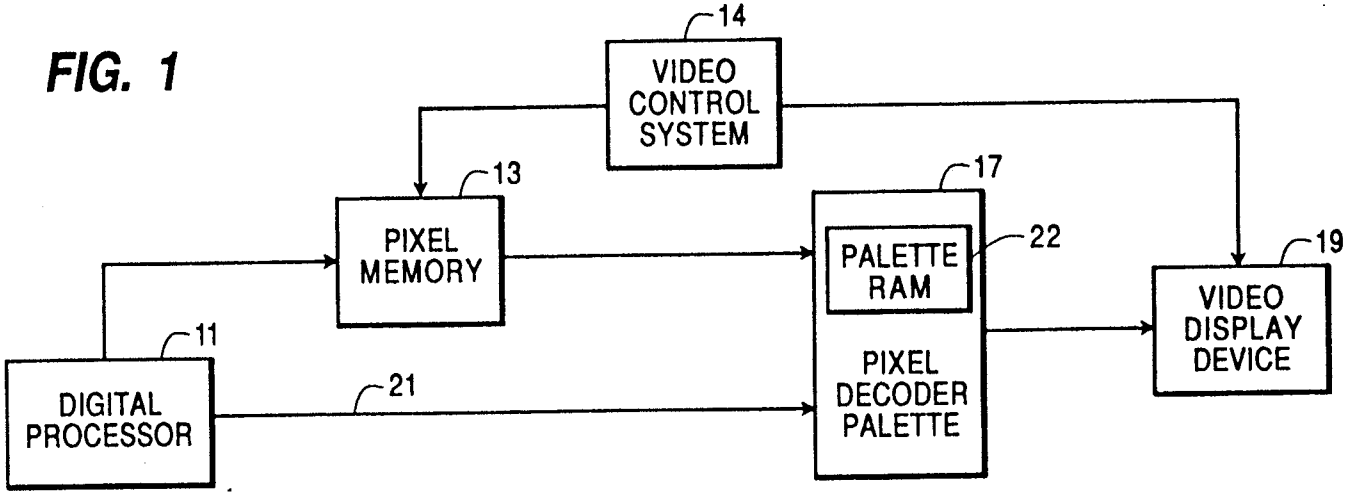
FIG. 1 is a block diagram illustrating a pixel based display system in which the system of the present invention is employed.

In the system of the invention as shown in FIG. 1, a digital processor 11 generates display data in the form of pixel words which are stored in a pixel memory 13. The pixel memory 13 stores pixel words representing an entire display frame of pixels representing a video frame to be displayed in pixels. In a conventional mode of operation, each pixel word stored in the pixel memory will control the color of a corresponding displayed pixel in the frame to be displayed. A video control system 14 reads the pixel words stored in the pixel memory 13 in sequence and applies them to a pixel decoder palette 17 which is implemented in a single integrated circuit chip. The video control system 14 applies video scanning signals directly to a video display device 19 in synchronism with the pixel words as they are read out of pixel memory 13. In response to the applied pixel Words, the pixel decoder palette generates red, green and blue video signals, which are applied to the video display device 19, which reproduces the image represented by the pixel words stored in the pixel memory.

In a conventional pixel word display system, each pixel word applied to the pixel decoder palette will represent an address in a random access memory, called the palette RAM, in the pixel decoder palette. The different memory locations in the palette RAM are each capable of storing data representing a color. A color is stored in the memory location in the random access memory in the form of three bytes, one byte representing the intensity of the color red, a second byte representing the intensity of the color green and the third byte representing the intensity of the color blue. When a pixel word is applied to the pixel decoder palette, this action causes a corresponding memory location in the random access memory to be read out and the color bytes are applied to digital-to-analog converters. The digital-to-analog converters convert the applied bytes to analog signals, which are the red, green and blue video signals applied to the video display device.

With the system described above, it will be apparent that the color of a component in a displayed image may be changed simply by changing the data in a memory location in the random access memory of a pixel decoder palette. In the system shown in FIG. 1, the processor 11 communicates with the pixel decoder palette 17 via I/O channel 21 and is operable to read out the colors stored in the palette RAM 22 on the I/O channel 21 or to store new colors in selected memory locations in the random access memory to thereby change the colors of different components in an image being displayed by the pixel words currently stored in the pixel memory.

Figure 2:
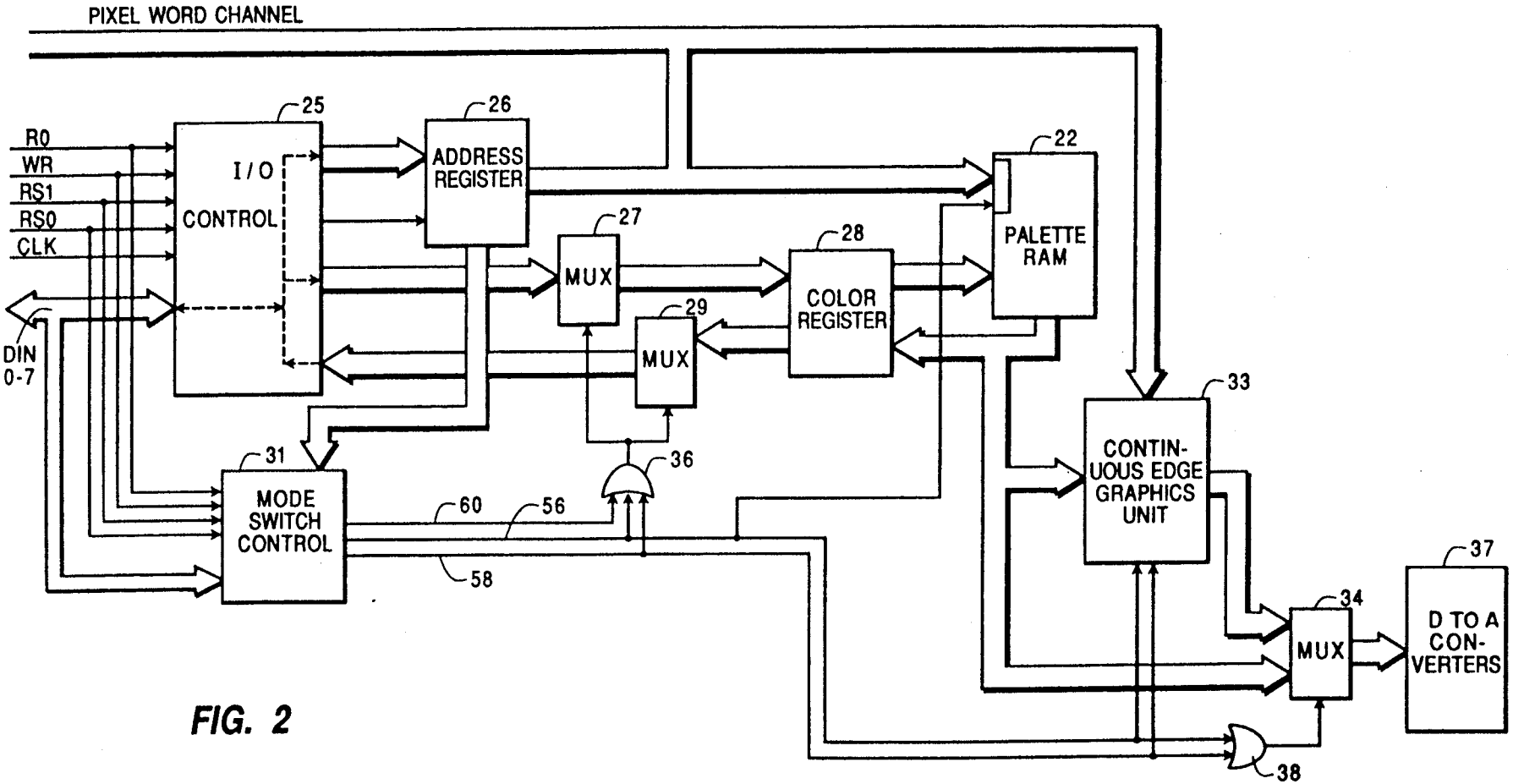
FIG. 2 is a block diagram illustrating the pixel word decoder palette of the present invention.

As shown in FIG. 2, the I/O channel 21 comprises an 8-bit data channel comprising bit signal lines Din0 through Din7, a write signal line WR, read signal line RD, steering signal lines RS1 and RS0 and a clock signal line CLK. The signals on the I/O channel are applied to an I/O control unit 25 from the digital processor 11. These same signals are also applied to a mode switch control 31. The I/O control unit 25 controls storing new colors in the RAM 22 or reading out color information from the RAM 22 in the same manner as in conventional pixel display systems. In these systems, the data channel Din0 through Din7, receive signals representing either an address location in the palette RAM for a color to be stored or read out from, or signals representing a color byte either for the color red, the color green or the color blue to be stored at a selected palette RAM location, or in the alternative transmits signals representing a color byte back to the signal processor 11 read out from an address location in the palette RAM. The RS1 and RS0 signals provide an indication as to whether or not the input signals on the channel Din0 through Din7 are an addressing command or a color command and steer the data bits to the proper channels.

The sequence of normal operation is as follows: If the signal processor 11 seeks to store a new color in a selected color location, it first applies the address of that color location to the data channel Din0 through Din7 in a write addressing command, in which the digital processor applies a write enabling signal to the write signal control line WR, binary 0 to the RS1 control line and a binary 0 to the RS0 control signal line. In response to this command and a clock signal received along with the control signals, the I/O control unit 25 will store the received address in a register 26 reserved for addresses and the I/O control unit will be set in a write mode. Following this storing of the write address in the address register 26 of the I/O unit, the digital processor will apply a byte representing the red color intensity to the data channels Din0 through Din7 in a write color command, in which an enabling signal will be applied to the write signal line, binary 0 is applied to signal line RS1 and binary 1 is applied to signal line RS0 along with a clock signal. In response to receiving these signals, the I/O unit will store the red color byte received on data channel Din0 through Din7 in a red byte section of a color register 28 of the I/O unit 25. The red color byte is applied to the color register through a multiplexer 27, the purpose of which is explained below. The digital processor 11 then applies the green byte to the data channel Din0 through Din7 in a write color command including the write signal, and the same RS1 and RS0 signals. In response to receiving these signals, the control unit will transmit the applied green color value received on the I/O data channel through the multiplexer 28 and store the green byte in the green byte section of the color register 28. Following this operation, the digital processor 11 applies the blue color value to the data channel in a write color command including a write signal on the signal line WR, and the same RS1 and RS0 signals. In response to receiving these signals, the I/O control unit 25 will transmit the blue color byte through the multiplexer 28 and store the blue byte in the blue byte section of the color register 28. The I/O control unit then causes the red, green, and blue color bytes in the color register 28 to be stored in the memory location selected by the address in the address register 26. In this manner, a new color can be stored in a selected memory location in the palette RAM.

After the color bytes are stored, the I/O control increments the address in the address register 26. Accordingly, if the digital processor continues to apply write color commands to the data channel without applying a new address to the data channel, the next three color bytes received on the data channel in sequence will be stored in a memory location incrementally higher than the memory location in which the first storage operation took place. Thus, new colors can be stored in sequential memory locations simply by applying additional red, green and blue color bytes to the data channel in sequence in write color commands.

The digital processor 11, to read out a color in a selected memory location, first applies to the I/O channel a read addressing command, in which the address of the selected memory location is applied to the data channel Din0 through Din7 along with an enabling signal to the write signal line WR and binary one to both RS1 and RS0. The I/O control unit 25 in response to receiving these RS1 and RS0 signals is set into the read mode and stores the address received on the data channels in the address register 26 and then reads out the red, green and blue color bytes stored in the memory location selected by the address in the address register 26. These color bytes are stored in the color register 28. Then following this action in response to read color commands in which read signals are applied to the read signal line RD and in which RS1=0 and RS0=1, the I/O control unit applies the red, green and blue color bytes in the color register 28 in sequence to the data channel Din0 through Din7. The color bytes are transmitted from color register 28 to the I/O lines Din0-7 through a multiplexer 29, the purpose of which is explained below.

After reading the color bytes from the palette RAM to the color register 28, the I/O control 25 increments the address register 26. This incrementing immediately after reading out a memory location is done automatically when the I/O control unit is in the read state, in which it was placed by the read address command at the start of the read operation. Then following the application of the color bytes from the color register 28 to the I/O data channel, the I/O control unit will read out the color bytes stored in the address location currently represented by the new incremented address in the address register 26. Then, if further read commands are applied to the I/O unit, the color bytes from the next incrementally higher address location will be applied in sequence to the I/O data channel. By continuing to apply read color commands to the I/O control unit 25, successively higher numbered address locations can be read out.

The above described operation of the I/O control unit is found in the prior art pixel coder palettes which the system of the present invention is designed to replace on a plug to plug compatible basis.

In some of these prior art systems, the palette RAMS stores the color bytes in each address location in 6-bit bytes and in some of the prior art systems, the color values are stored in 8-bit bytes. The system of the present invention is designed to replace both the 6-bit and 8-bit byte pixel decoder palettes on a plug to plug compatible basis. In furtherance of this object, the color bytes received from the data channel Din0 through Din7 are applied from the I/O control unit to the color register 28 to be stored therein through a multiplexer 27 and the color bytes are read out from the color register 28 to the I/O control unit and then to the data channel through a multiplexer 29. The multiplexers 27 and 29 are controlled by mode switch control 31, which is operable to switch the multiplexers 27 and 29 to two different states. In one state, the multiplexers pass 8-bit input bytes through to the output side of the multiplexers without alteration. In the alternative state of operation, the multiplexer 27 shifts the six least significant bits of each byte to the six most significant bit positions and applies zeros to the two least significant bit positions. In the alternate state, the multiplexer 29 shifts the six most significant input bits of each byte to the six least significant output bit positions and applies zeros to the two most significant bit positions. The multiplexers can be switched to either state under the control of the mode switch control unit 31. Upon powering up, the mode switch control unit 31 will automatically go into a state for 6-bit bytes so that it controls the multiplexers 27 and 29 to operate in the above described alternate state. In a manner to be described below, the mode switch control unit 31 can be switched by the control signals on the signal lines WR, RS1 and RS0, and the signals applied to the data channel Din0 through Din7 to select different modes of operation. In these modes of operation, the colors are represented by 8-bit bytes and the multiplexers 27 and 29 are switched to the state in which they pass the 8-bit bytes to the output without shifting.

In addition to powering up in the 6-bit color byte mode, the mode switch control system 31 is also set into a mode state in which colors are represented as pixels in the conventional manner; that is, continuous edge graphics are not employed to smooth edges at boundary lines between displayed objects. Thus, upon powering up, the mode switch control sets the pixel decoder palette in a state to respond to signals in which the color bytes are represented as 6-bit bytes and the pixels are displayed as in a conventional pixel display system with no edge smoothing. In the specific embodiment, one of the modes selectable by the mode switching control 38 involves representing pixels in the conventional manner but using 8-bit color bytes. Other modes of operation selectable by the mode switch control 31 involve continuous edge graphics. In the specific embodiment, there are two continuous edge graphic modes that can be selected both of which employ 8-bit color bytes. One continuous edge graphic mode is called the bit divide mode. A second continuous edge graphics mode of operation is called the pixel delay mode of operation. The mode switch control unit can enable circuitry in a continuous edge graphics unit 33 of the invention to carry out either continuous edge graphics mode of operation.

In the bit divide mode of operation, the pixel words received on the pixel channel are divided into two parts. The three most significant bits represent an address in the palette RAM and the five least significant bits represent a mix value. In pixel words corresponding to pixels bridging a boundary between objects, the mix value will represent the percentage of the old color before the boundary to be mixed with a reciprocal percentage of the new color after the boundary in the boundary bridging pixel.

In the pixel delay continuous edge graphic mode of operation, each pixel word applied to the pixel decoder palette represents either a color value in the form of an address storage location in the palette RAM or represents a mix value. In this mode, the values of the 8-bit pixel word from 0 to 127 represent color values and the values of the pixel words from 128 to 255 represent mix values. When an object is to be displayed requiring mixing of the old and new colors on a pixel bridging the object edge, the pixel word preceding the pixel bridging the object edge contains the new color to be displayed after the object edge. The pixel word corresponding to the edge bridging pixel contains the mix value, which indicates the amount of old and new colors to be mixed together in the pixel bridging the object edge. Both the bit divide and pixel delay modes of continuous edge graphics are fully described in U.S. Pat. No. 4,704,605.

As shown in FIG. 2, the pixel words received on the pixel word channel, in addition to being applied to the palette RAM 22, are also applied to the continuous edge graphics unit 33, which also receives the color intensity values read out from the palette RAM 22 in response to the applied pixel words. When the continuous edge graphics unit is enabled in one of the continuous edge graphics modes, the continuous edge graphics unit uses the mix values in the applied pixel words and the intensity values received from the palette RAM to determine the red, green, and blue intensity values for each pixel and applies these values through a multiplexer 34 to the digital-to-analog converters 37. When the system is operating in a conventional pixel mode instead of a continuous edge graphics mode, the multiplexer 34 applies the intensity values read out from the palette RAM 22 directly to the digital-to-analog converters.

The mode switch control 31 has three output signal lines 56, 58 and 60 and generates an output signal on one of these lines whenever it is switched out of the 6-bit byte conventional pixel mode. When switched to an 8-bit byte conventional pixel display mode, the mode switch control produces an output signal on signal line 60 which is applied through OR gate 36 to the multiplexers 27 and 29 to switch these multiplexers to pass the bit signals without shifting. The signal lines 56 and 58 are used to select the pixel delay mode and the bit divide mode of continuous edge graphics.

Both of the continuous edge graphic modes employ 8-bit color intensity bytes. Thus, when the mode switch control 31 is switched out of the conventional 6-bit byte mode to either the conventional 8-bit byte mode, or either of the continuous edge graphics mode, the mode switch control 31 will apply a signal from one of the output signal lines 56, 58 or 60 through OR gate 36 to the multiplexers 27 and 29 to switch the multiplexers to pass 8-bit input signals to o corresponding output signal lines without shifting. The output signal lines 56 and 58 are connected to the continuous edge graphics unit 33 and the mode switch control 31 applies a signal on one of the signal lines 56 or 58 to select one of the continuous edge graphics modes. The multiplexer 34 will normally apply the pixel values read out from the palette RAM 22 directly to the digital-to-analog converters. When the mode switch control 31 is switched to one of the continuous edge graphics modes, the enabling signal applied from the mode switch control 31 on one of signal lines 56 or 58 to the continuous edge graphics unit 33 will also be applied through OR gate 38 to multiplexer 34 to switch the multiplexer 34 to apply the intensity values received from the continuous edge graphics unit 33 to the digital-to-analog converters.

To switch the system out of the 6-bit byte conventional pixel mode to one of the other modes of operation, the digital processor 11 applies a series of input commands, called the mode switching sequence, on the data channel Din0 through Din7 and the WR, RS1 and RS0 signal lines. These commands are all applied to the mode switch control 31. The particular sequence of signals applied are in a sequence which is not used in pixel display conventional systems. The last command of the mode switching sequence contains the information byte, which indicates the mode into which the system is being switched.

In the specific embodiment of the invention, the specific sequence of commands consists of a read addressing command with address 222 followed by three write color commands with predetermined data bytes, and then repeating this sequence twice more with the same address in each iteration but with different predetermined data bytes. The first command of the sequence involves applying a write signal to the write signal line WR, applying binary one to the signal lines RS1 and RS0 and applying the address 222 to the data channel Din0 through Din7. The signal applied to the write signal line along with the signals RS1 and RS0 indicate that the data applied to the data channel Din0-Din7 is an address to go into the address register 26. In response to the RS1 and RS0 signals, the I/O control unit is set in a read state. In the next three commands (write color commands), three successive predetermined bytes of data are applied to the data channel along with binary 0 applied to the signal line RS1 and a binary 1 applied to the signal line RS0. An enabling signal is also applied to the write signal line. This combination of signals indicates to the I/O control unit 25 that the three successive bytes are to be stored in the palette RAM. After these three commands, the digital processor then again applies the read addressing command with the same address 222 to the I/O channel followed by three more write color commands. The sequence of a read addressing command with addresses 222 followed by three more write color commands is repeated a third time. In the last command of the sequence, which is a write color command, the digital processor applies a byte of data, called the information byte, to the data channel to select the mode of operation into which the pixel decoder palette is to be set. Thus, the mode switching sequence involves 11 specific commands of data and signals applied to the data channels Din0–Din7 and signal lines WR, RS1 and RS0 followed by a last and 12th command containing the information byte which selects the mode into which the pixel decoder palette is being set. If the first 11 commands occur in sequence, then in response to the 12th command of the sequence, the mode switch control 31 will set the pixel decoder palette in the mode selected by the information byte applied to the data channel in the 12th command of the sequence.

As described above, the mode switching sequence is three repetitions of four commands, the first command of which is a read addressing command. The second through fourth commands of each repetition are write color commands. Thus, the first command is from a sequence for reading out data and the second through fourth commands are from a sequence for storing data in the palette RAM. Accordingly, the mode switching sequence is a sequence of steps or commands applied to the I/O channel which is different from that used to read data out from the palette RAM or store new colors in the palette RAM. For this reason, as well as the requirement of specific values in the mode switching sequence for the addresses and data in the sequence, it is extremely improbable that the digital processor might apply the mode switching sequence to the pixel decoder palette by accident.

Figure 3:
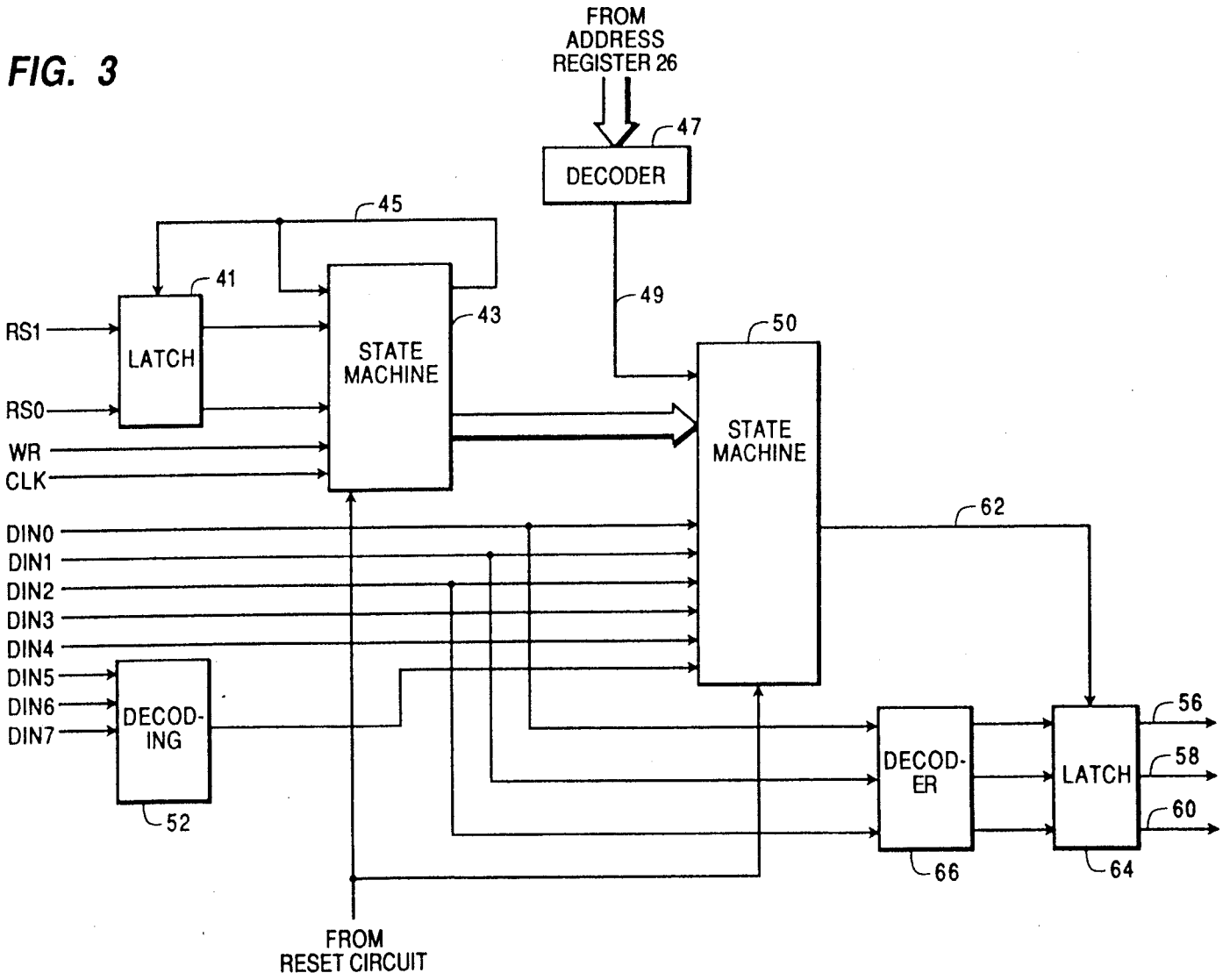
FIG. 3 is a block diagram illustrating details of the mode switch control of the pixel word decoder palette shown in FIG. 2.

FIG. 3 is a circuit diagram showing details of the mode switching control 31 of the present invention. As shown in FIG. 3, the RS1 and RS0 signals are applied to a latch 41, which latches these signals and applies them to a state machine 43. The write signal on signal line WR and the clock signal on signal line CLK are also applied to the state machine 43. The state machine 43 is a programmable logic array and flip/flop circuit, which, based on various logic inputs, advances through a sequence of states which are represented by the condition of output flip/flops. The initial state is the reset state and from this reset state, the state machine advances to states named A through F in sequence. The output flip/flops of the state machine 43 generate a 5 bit binary signal indicating the state of the state machine. In addition, the state machine 43, in response to the write signal applied on channel WR, produces the same signal on output signal line 45 upon receipt of the next succeeding clock pulse. Thus, the signal on signal line 45 will be the same as the signal on signal line WR one clock pulse later. This signal on signal line 45 is called WASWR. The WASWR signal on channel 45 is applied to the latch 41 to reset the latch and is also applied to a logic input of the state machine 43.

The reset signal generated by the power up circuit of the pixel decoder palette is also applied to the state machine 43 and will set the state machine 43 in its reset state. When in its reset state, the state machine 43 will be advanced to its state A in response to receiving the write signal on signal line WR in combination with the RS1 signal and RS0 signal received from the latch 41 equalling 1. As a result, when the write signal along with 1 values of RS0 and RS1 are applied to the input signal lines at the time the address 222 is applied to the I/O data lines in a read addressing command, the state machine 43 will be advanced to its state A.

When the state machine 43 is in state A and the write signal goes to 0 along with the appearance of the WASWR signal on the next clock pulse, the state machine 43 will be advanced to its state B. Thus, on the next clock pulse following the read addressing command with address 222 to the I/O data channels, the state machine 43 will be advanced to state B.

When the state machine is in state B and the latch 41 applies and RS1 value equal to 0 and an RS0 value equal to 1 and the write signal ends indicated by the absence of the write signal and the presence of the WASWR signal, the state machine 43 will advance to its state C. Thus, when the first write color command is applied to the I/O channel following the read addressing command in the mode switching sequence, the state machine 43 will be advanced to state C at the time the write signal terminates.

When the state machine 43 is in state C it will be advanced to the state D in response to the termination of the write signal and in response to the latch 41 applying RS1=0 and RS0=1. Accordingly, the state machine 43 is advanced to the state D when the second write color command is applied to the I/O channel following the read addressing command with address 222.

When the state machine 43 is in state D, it will be advanced to its state E when the write signal terminates and the latch 41 applies RS1=0 and RS0=1. Thus, when the third write color command is applied to the I/O channel following the read addressing command with the address 222, the state machine 43 will be advanced to state E.

From state E, the state machine advances automatically to state F, whereupon it automatically returns back to state B. In this manner, the state machine 43 is caused to cycle through the B, C, D, E and F states and then return to state B in response to the RS1 and RS0 signals and the write signals applied to the mode switch control 31 in the write color commands applied to the I/O channel in the mode switching sequence following the application of the read addressing command.

As explained above, following the first three write color commands applied to the data channel following the read addressing command in the mode switching sequence, a read addressing command with address 222 again is applied to the I/O channel to again cause the address 222 to be stored in the address register of the I/O control 25. These signals will not affect the state machine 43, which will remain in state B. Then in response to the application of the RS1=0 and RS0=1 signals and the write signals in the next three write color commands in the mode switching sequence, the state machine 43 will be caused to cycle through states C, D, E and F and then return to state B as described above. The sequence of the operation of the state machine 43 will then again be repeated for the third three write color commands following the third application of the read addressing command of the mode switching sequence. At any time during this sequencing of the state machine 43 should a reset signal be applied to the state machine 43, such signal will cause the state machine 43 to return to its reset state. Also, if the state machine 43 while in its B, C or D states receives a write signal along with a combination of RS1 and RS0, other than RS1=0 and RS0=1, the state machine 43 be returned to its reset state.

Signals representing the address stored in the address register 26 are applied to a decoder 47 in the mode switch control 31 and whenever the address 223 is present in the address register, the decoder 47 will generate an output signal called the key location signal on an output channel 49. As indicated above, the address 222 is stored in the address register 28 three times during the mode switching sequence. Because the address is a read addressing command indicated by values of RS1 and RS0 equal to 1, the I/O control unit immediately following the storing of address 222, reads out then color values at this address to color register 28 and then increments the address in address register 26 to 223. As explained above, this incrementing of the address register 26 is part of the normal operating procedure in reading out data from the palette RAM to the I/O data channel and enables the signal processor to read out the next successive memory location in sequence without applying a new address to the I/O data channel. Because of this incrementing, the decoder 47 will apply the key location signal to the channel 49 immediately following the application of the address 222 to the I/O data channel in the mode switching sequence.

The state machine 43 generates a 5-bit binary output signal representing the state that the state machine is currently in, reset, A, B, C, D, E or F to a state machine 50, which also receives the key location signal applied on channel 49. In addition, the state machine 50 also receives the binary signals on the input data signal lines Din0–4 and a signal from a decoder 52, which receives the binary signals on signal lines Din5–7. The decoder 52 applies a signal, called the DATA OK signal to the state machine 50 in response to a predetermine combination of bits on signal lines Din5–7. The bits Din5–7 in each of the nine bytes in the write color commands of the mode switching sequence are the same and coincide with the predetermined combination which will cause the decoder 52 to generate the DATA OK signal. Thus, the DATA OK signal indicates that bits Din5–7 of a data byte of a write color command are the correct values in the mode switching sequence. The state machine 50 like the state machine 43 is implemented by a programmable logic array and a series of output flip/-flops and can be advanced from state to state in response to predetermined inputs. The initial logic state of the state machine 50 is 0 and the state machine 50 is reset to the initial state 0 whenever the reset signal is received from the power up circuitry. When the state machine is in the initial state 0, it will be advanced to a state 1 in the response to the presence of the key location signal, the state machine 43 being in state C, a predetermined set of binary bits applied to Din0–4 equal to these bits in the data byte of the first write color command of the mode switching sequence and the DATA OK signal. Accordingly, in response to the first write color command of the mode switching sequence, the state machine 50 will be advanced to the state 1. When the state machine 50 is in the state 1, it will be advanced to the state 2 in response to the presence of the key location signal, the DATA OK signal, the state machine 43 being in state D, and another predetermined set of binary bits applied to data signal lines Din0–4, identical to these bits applied to the input data channel in the second write color command of the mode switching sequence. If the wrong combination of bits are received on signal lines Din0–4, when the state machine 43 is in state D, the state machine 50 will be returned from state 1 to state 0. When the state machine 50 is in the state 2, it will be advanced to its state 3 in response to the presence of the key location signal, the DATA OK signal, the state machine 43 being in state F and a third predetermined set of binary bits applied to the input channels Din0–4, which are identical to the bits applied to these data signal lines in the third write color command of the mode switching sequence. If the wrong combination of bits are received on signal lines Din0–4 when the state machine 43 is in state F, the state machine 50 will be returned to state 0. In this manner, the state machine 50 is advanced to the state 3 in response to the first four steps of the mode switching sequence, which as explained above is the address 222 applied to the input data channel in the read addressing command followed by the three successive write color commands with predetermined data bytes.

At this point of the mode switching sequence, the state machine 43 will have been returned to state B. The next step in the key switching sequence as described above is the reapplication of the address 222 in a in a read addressing command. This restores the address 222 in the address register 26, which will have been incremented to address 223 by automatic action of the I/O control 25 following application of the address 222 to the I/O control 25 in the first step of the mode switching sequence. The state machine 43 remains in the state B and the state machine 50 remains in state 3, in response to this command of the mode switching sequence. In response to the next three commands of the mode switching sequence, in which specific data bytes are applied to the input data channel in write color commands, the state machine 50 is advanced through states 4, 5, and 6. At this point the state machine 43 will again return to its state B. Then, in the mode switching sequence, the address 222 is again applied to the input data channel in a read addressing command. This command again stores the address 222 in the address register 26, which again is immediately incremented to 223. The state machine 43 remains in state B and the state machine 50 remains in state 6 when these signals are applied to the I/O channel. Then in response to predetermined data bytes in the next two write color commands of the mode switching sequence, the state machine 50 will be advanced into states 7 and 8. State 8 is called the key state. As described above, the advancing of the state machine from state 0 to state 8 requires for each step of the advance a combination of the key location signal, the DATA OKAY signal, a predetermined combination of bits on Din0–4 and the state machine 43 being in a selected one of its states. For example, for the state machine 50 to go from state 3 to state 4, the state machine 43 must be in state C and for the state machine 50 to go from state 4 to state 5, the state machine 43 must be in its state D. If while the state machine 50 is in any one of the states 1 through 7, an incorrect combination of bits are received on input lines DO through D4, while the state machine 43 is in the correct state to cause the state machine 50 to advance to the next state, this wrong combination of bits will cause the state machine 50 to return to its state 0. As a result, the applying of the wrong data byte in the write color command in what otherwise will be a proper mode switching sequence will cause the state machine 50 to return to its state 0. Also, if while the state machine 50 is in its state 1, 2, 4, 5 or 7 and it does not receive the DATA OK signal, the state machine 50 will be returned to its state 0. The state machine 50 is not returned from state 3 or state 6 to state 0 in response to the absence of the DATA OK signal, because the state machine 50 will be in these states when the read address command of the mode switching sequence is received and, accordingly, the DATA OK signal will not be applied to the state machine 50 part of the time that the state machine 50 is in states 3 and 6.

When the state machine 50 reaches the key state, it produces the CEG mode enabling signal on its output channel 62 to enable a latch 64 to store the output signals from a decoder 66. Then during the last command of the mode switching sequence, when the information byte of the mode switching sequence is applied to the input data channel in a write color command, the binary bits on input data signal lines Din0–2 select the mode into which the pixel decoder palette is switched. The signals Din0–2 are applied to the decoder 66 and the decoder 66 will produce via the latch 64 an output signal on one of three output channels 56, 58 or 60 depending on the values of the input signals, Din0, Din1 and Din2 to select an operating mode. In this manner, the pixel decoder palette is switched into the selected mode of operation in response to the specific sequence of commands of the mode switching sequence.

At the completion of the mode switching sequence, the I/O control 25 will store data currently in the color register 28 in the palette RAM at the address specified in the address register 26. In response to the last three write color commands of the mode switching sequence, the I/O control 25 will store bytes received on the I/O data channel in color register 28. At the time this data is stored in the palette RAM, the address register 26 will have been incremented to 223 by the I/O control 25. Accordingly, the last three data bytes of the mode switching sequence are stored in the red, green and blue byte positions of the memory location at address 223 of the palette RAM. As a result, the blue byte section at address 223 will contain data indicating the current mode into which the pixel decoder palette has been switched.

To switch the state machine back to the 6-bit byte conventional pixel display mode, a new color is written into the address location 223. When this happens, the state machine 50 is returned to state 0 from the key state. To write a new color into address location 223, the digital processor applies the address 223 to the I/O data channel Din0–7 in a write addressing command, in which RS1=0 and RS0=0. In response to these signals, the I/O control unit stores the address 223 in the address register 26 and the I/O control unit 25 is placed in the write mode. Accordingly, the decoder 47 will generate the key location signal on channel 49. Then, when the red byte of the new color is applied to the I/O data channel Din0–7 in a write color command, the state machine 43 will be advanced to state C. In response to the state machine 43 being in state C and the key location signal, the state machine 50 will be returned from the key state back to its initial state 0. When the state machine 50 is switched out of the key state, the latch 64 is reset so that no enabling signal is applied to one of the output channels 56, 58 and 60.

To switch the mode switch control to a different mode, other than the 6-byte conventional mode, the mode switching sequence is reapplied to the I/O channel.

Figure 4:
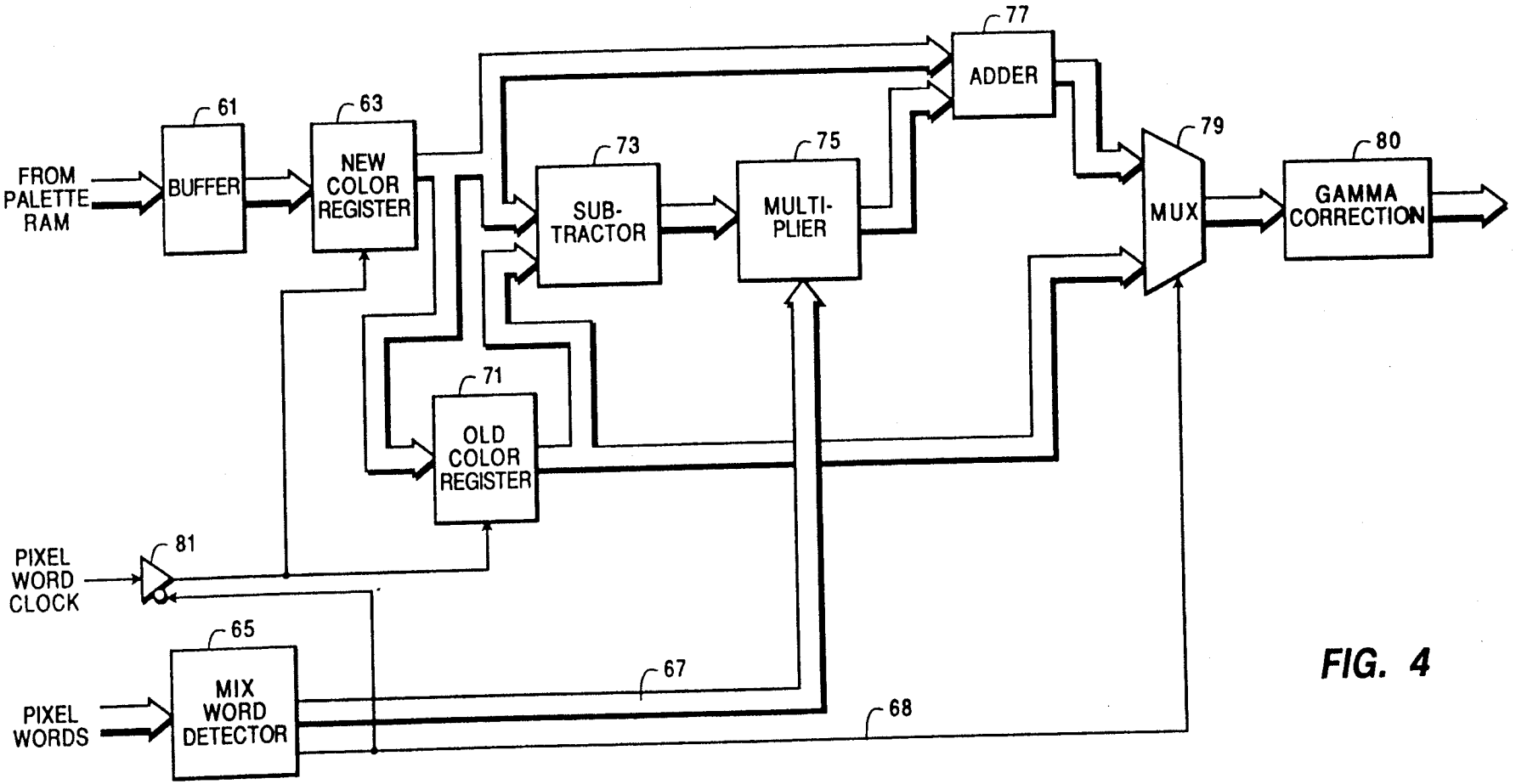
FIG. 4 is a block diagram illustrating a configuration into which the continuous edge graphics unit of the decoder of FIG. 2 is switched to carry out one continuous edge graphics mode of operation.
Figure 5:
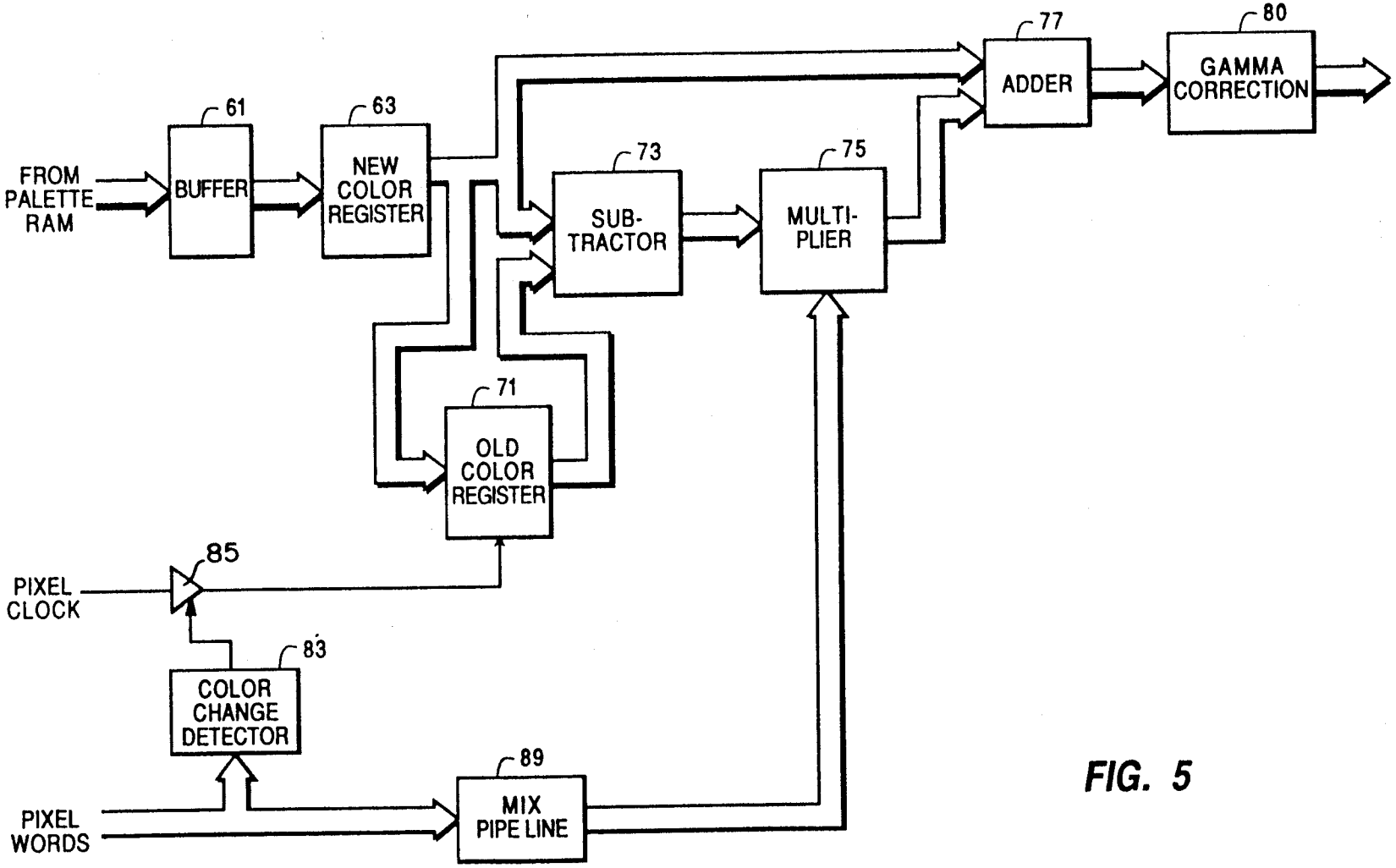
FIG. 5 is a block diagram of a second configuration into which the continuous edge graphics unit can be switched to carry out another continuous edge graphics mode of operation.

FIGS. 4 and 5 are block diagrams of the configuration of the continuous edge graphics unit 33, FIG. 4 showing the configuration of the unit when it is switched into the pixel delay continuous edge graphics mode in response to an enabling signal on signal line 56 and FIG. 5 illustrating the configuration of the continuous edge graphics unit when it is switched into the bit divide continuous edge graphics mode in response to a signal on signal line 58. Both FIGS. 4 and 5 show the system for one of the three basic video colors red, green and blue, the system being duplicated for each of the three colors. The continuous edge graphics system as explained above determines for each color an average or mixed intensity value for each pixel bridging a boundary between objects. To determine this mixed value, a mix number is furnished in the pixel word data representing the percentage of the old intensity value, that is the color on the left side of the boundary to be combined with a reciprocal percentage of the color on the right side of the boundary. A straight forward way of calculating the intensity value for the mixed color intensity would be: $MC_o+(1-M)C_n$ in which M is the mix percentage, $C_o$ is the old color intensity and $C_n$ is the new color intensity. This formula works out algebraically to equal $C_n+M(C_o-C_n)$. Both configurations shown in FIGS. 5 and 4 make this latter calculation.

As explained above, the configuration shown in FIG. 4 computes the contiguous edge graphics output in accordance with the pixel delay mode. In this mode, the palette RAM addresses from 0 to 222 are used for color intensity values. Any pixel word representing addresses from 223 to 255 is a mix value and can be recognized as a mix value by the fact that the three most significant bits of the pixel word are all binary ones. Each pixel bridging an edge or boundary will correspond to a pixel word containing a mix value. In the pixel delay mode, each time a pixel word representing a color is applied to the palette RAM, it reads out a color intensity value to the buffer register 61 in the circuit shown in FIG. 4. At the same time the color intensity is caused to be transferred from the register 61 to the new color register 63 by the pixel clock pulse accompanying the pixel word causing the latest color intensity to be registered in the register 61. At the same time, the color intensity value stored in new color register 63 is transferred to old color register 71 by the pixel clock pulse. The pixel clock pulse is applied to the registers 61 and 73 through a gate 83 to effect the shifting of intensity values between registers 61, 63 and 71. Each of the pixel words in addition to being applied to the palette RAM are also simultaneously applied to the mix detector 65, which registers an applied pixel word. The mix detector 65 normally enables the gate 81 to pass the applied pixel clock pulses to the register 63 and the register 71 to effect shifting of the color intensity values. When the mix detector 65 registers a mix value indicated by the fact that the three most significant bits are binary ones, the mix detector, by an output signal on line 68, disables the gate 81 so that the next pixel clock pulse following a mix value will not shift intensity values from the buffer 61 to the new color register 63 or from the new color register 63 to the old color register 71. When the pixel word registered in the mix detector is a mix value, this fact is indicated by the signal on line 68 and the mix detector produces a 5-bit value on a 5-bit output channel 67 corresponding to the five least significant bits of the pixel word registered in the mix detector. Thus the five bit value on channel 67 will represent the mix percentage on a scale of 0 to 32, wherein the value 32 would represent 100% and the value 0 would represent 0%. Since the value 32 cannot be represented in 5 bits, the mix percentage actually ranges from 0 to 97%.

When a mix value following color intensity values is applied to the mix detector 65, the color value preceding the mix value will be registered in the new color register 63 and the color value before that will be registered in the old color register 71. The values registered in registers 63 and 71 are subtracted in subtractor 73 to obtain a value representing the old color intensity minus the new color intensity which is applied to a multiplier 75. The mix detector 65 applies the mix value representing the mix percentage on channel 67 to the multiplier 75 where the mix value is multiplied times the intensity difference applied from the subtractor 73. The color intensity in the new color register 63 is added to the product represented by the output of the multiplier 75 in an adder 77, which produces an output applied to a multiplexer 79. The output of the adder 77 thus, will be: $C_n+M(C_o-C_n)$. When two or more mix values in succession follow color values, as will happen when the boundary edge slopes gradually, the color value immediately preceding the first mix value of the sequence is retained in the new color register and the color before that is retained in the old color register. As a result, when a mix value is applied to the mix detector 65, the output of the adder 77 will correctly represent the color intensity value for the pixel bridging the boundary, which pixel corresponds to the pixel word containing the mix value. The output of the adder 77 is applied to a multiplexer 79, which also receives the value stored in the old color register 71. The output of the multiplexer 79 is applied to a gamma correction circuit 80. The mix detector output on channel 68 switches the multiplexer 79 so that it will apply the output of the adder 77 to the gamma correction circuit 80 when a mix value is registered in the mix detector. At all other times, the multiplexer 79 will apply the color intensity value stored in the old color register 71 to the gamma correction circuit 80. The gamma correction circuit is a look-up table which reads out a gamma corrected intensity value corresponding to the received intensity values. The gamma corrected intensity values are applied to one of the digital-to-analog converters 37, which generates a color video signal corresponding to the gamma corrected video signal. Thus, the digital-to-analog converter will produce a color video signal corresponding to the mixed intensity value produced by adder 77 and gamma corrected by circuit 80 when the mix detector detects that the received pixel word is a mix value. At all other times, the digital-to-analog converter will produce a color video signal corresponding to the intensity value stored in the old color register 71 gamma corrected by the circuit 80.

When the mix value is applied to the palette RAM, it will cause a value to be stored in the register 61, which does not represent any color intensity. This color intensity will not advance to the old color register 71 and thus eventually become displayed in a pixel because the signal on channel 68 indicating the presence of a mix value disables the gate 81 through which the pixel clock must pass to cause the new color register 63 to be loaded with the intensity value in register 61. Thus, the color intensity value stored in the register 61 in response to the pixel word containing the mix value will not get transferred to the new color register 63 at the time of the next pixel clock and the color intensity value stored in the register 63 will remain the same value as before.

FIG. 5 represents the configuration of the continuous edge graphics unit to achieve the bit divide mode of operation. In this mode of operation, when the pixel word is applied to the address port of the palette RAM, the 5 least significant bits of the pixel word are forced to 0 by the enabling signal on channel 58 selecting the CEG bit divide mode, as shown in FIG. 2, so that only the three most significant bits of the pixel word select the color intensity values. In this mode of operation, the color intensity value read out by the applied pixel word is stored in the buffer register 61 and then advanced into the new color register 63 by the next pixel clock pulse. The three bits of the pixel word representing a color are applied to a color change detector 83 which generates an output signal to enable a gate 85 to pass the pixel clock to the old color register 71 when the color change detector 83 detects that the color represented by the pixel word has changed. This action advances the color value in the new color register 63 to the old color register 71. Accordingly, when the pixel words indicate that the color has changed, the old color register 71 is updated by the value previously stored in the new color register 63. At the same time, the color value corresponding to the new color which causes the updating of the old color register will become stored in the new color register. Accordingly, each time a pixel word is received representing a new color, the color represented by the three most significant bits of the pixel word will be stored in the new color register and the color represented by the previous pixel word will be stored in the old color register. The outputs in the new color register and old color register are interconnected with the subtractor 73, the multiplier 75 and the adder 77 in the same manner as in the configuration of FIG. 5. The output of the adder 77 is applied to the gamma correction circuit 80. The mix value represented by the five least significant bit values of the applied pixel words are applied to a pipe line 89, which under the control of the pixel clock delays the mix values by one clock pulse and applies the delayed mix values to the multiplier 75 so that each mix value is applied to the multiplier 75 at the same time that the color value corresponding to such mix value is stored in the new color register 63. The multiplier 75 performs a multiplication of the mix value with the difference value in the same manner as in the system of FIG. 4. As a result, the system shown in FIG. 5 will mix the colors for each pixel bridging a boundary from the colors on each side of the boundary. For each pixel which does not bridge a boundary between objects, the color intensity stored in the old color register and the new color register will be the same. As a result, the output from the multiplier 75 will be 0 and the adder will produce an output color intensity equal to color in the new color register which will be the correct color for any pixel which does not bridge a boundary between objects. In this manner the bit divide continuous edge graphic mode provides the correct color values and the appropriate shading for pixels which bridge boundaries between objects.

In the above described specific embodiment, the mode switching sequence is used to switch the mode of operation from the start-up mode in which color components are represented by six-bit bytes and pixels are displayed in the conventional manner, to three other selectable modes of operation, each of which employ color components represented by eight-bit bytes. In one of the three selectable modes, the pixels are displayed in the conventional manner and the other two selectable modes employ edge smoothing to reduce aliasing by mixing colors and pixels which bridge boundaries between objects. It will be apparent that the mode switching sequence could be used to switch the pixel decoder palette into other selected modes of operation in addition to those described in the specific embodiment. For example, the mode switching sequence could be used to select a mode of operation in which registers store values which are added to the color values which are read out from the palette RAM in response to the pixel words applied on the pixel word channel, to thus change brightness of the display mode. The mode switching sequence could be used to switch in gamma correction in a conventional pixel display. The mode switching sequence could be used to transmit general operating parameters to the pixel decoder palette without switching the mode of operation. For example, the information transmitted in the information byte of the mode switching sequence could identify screen points in the display defining a window edge. The mode switching sequence could include more than an information byte, in which case one of the information bytes could select the mode and a second information byte could contain a parameter to be used in the mode. These and other modifications of the above described specific embodiment of the invention may be made without departing from the spirit and scope of the invention which is defined in the appended claims.

What is claimed is:

1. In a pixel display system comprising a palette random access memory having a multiplicity of memory locations, each capable of storing a value representing a color to be displayed, means to apply address words over a first channel in sequence to said palette random access memory to read out said values from said memory locations selected by said address words, means to generate a pixel based display in accordance with the values read out from said random access memory, and control means connected to receive multibit commands in time sequence over a second channel and responsive to a first time sequence of said commands to control the storing of new color values in said random access memory, one of said commands of said first time sequence including the address at which the new color is to be stored and other commands of said first time sequence identifying color components of said new color to be stored at the address, the improvement comprising mode switching means connected to receive said multibit commands and operating to switch the mode of operation of said pixel display system in response to a predetermined second time sequence of said commands, said predetermined second time sequence of commands being different than said first sequence of commands.

2. In a pixel display system as recited in claim 1, wherein said second channel comprises an I/O channel and further comprising a digital processor connected to said control means and said mode switching means by said I/O channel, said digital processor being operable to apply said commands to said control means and said mode switching means via said I/O channel, said control means being responsive to a third time sequence of said commands to read out color values from said random access memory and transmit the read out color values to said digital processor via said I/O channel, said third sequence of commands being different than said predetermined second sequence of commands.

3. In a pixel display system as recited in claim 2, wherein said predetermined second sequence of commands include commands of said first sequence and commands of said third sequence.

4. In a pixel display system as recited in claim 1, wherein said mode switching means is operable to switch the mode of operation of said pixel display system from one in which intensity values stored in said random access memory are represented by a first number of bits to a mode in which intensity values stored in said random access memory are represented by a second number of bits different than said first number of bits.

5. In a pixel display system as recited in claim 1, wherein said pixel display system has a conventional mode of operation in which it displays each pixel of the display in accordance with a color read out from said random access memory and a second mode of operation in which said pixel display system displays some pixels bridging boundaries of a displayed object as mixes of the colors on each side of said boundary, said mode switching means switching said pixel display system between said modes in response to said predetermined second sequence of commands.

6. In a pixel display system as recited in claim 1 including means to operate in a conventional first mode to display an image in which each pixel of the image is represented by a color read out from an address location in said random access memory, said pixel display system having second and third modes of operation and means operable when said pixel display system is in said second and third modes of operation to display an image in which pixels bridging a boundary of an object to be displayed are displayed as mixes of colors stored in said random access memory corresponding to the colors on each side of said boundary in said image, said mix values being represented in said address words in different ways in said second and third modes, said mode switching means switching said pixel display system to said second mode of operation in response to said predetermined sequence of commands containing a first predetermined data value in one of said commands and switching said display system to said third mode in response to said predetermined second sequence of commands containing a second predetermined data value in one of said commands.

7. In a pixel display system as recited in claim 1, wherein said commands in second sequence contains data values and wherein said mode switching means will switch said pixel display system from a first mode to a second mode of operation only if the commands of said second sequence contain predetermined data values.

8. In a pixel display system as recited in claim 7, wherein said mode switching means is operable to switch said pixel display system from said first mode of operation to a third mode of operation only if said second sequence of commands contains a second set of predetermined data values, one of which is different than said first mentioned set of predetermined data values.

9. In a pixel display system as recited in claim 1, wherein said palette random access memory, said control means and said mode switching means are integrated into a single integrated circuit chip.

10. In a pixel display system comprising a palette random access memory having a multiplicity of memory locations, each capable of storing a value representing a color to be displayed, means to apply address words in sequence to said palette random access memory to read out said values from said memory locations selected by said address words, means to generate a pixel based display in accordance with the values read out from said random access memory, control means, and a digital processor connected to said control means to apply multibit commands in sequence to said control means, said control means being responsive to a first sequence of said commands to control the storing of new color values in said random access memory and responsive to a second sequence of commands to read out color values from said random access memory and transmit the read out color values to said digital processor, the improvement comprising control means connected to receive said multibit commands and operating to control said pixel based display in response to a predetermined third sequence of said commands including commands of said first sequence and of said second sequence.

11. In a pixel display system comprising a digital processor and a pixel decoder palette connected to said digital processor, said pixel decoder palette including a palette random access memory having a multiplicity of memory locations, each capable of storing a value representing a color to be displayed, means to receive address words in sequence and apply said address words sequentially to said palette random access memory to read out said values from said memory locations selected by said address words, and means to generate a pixel based display in accordance with the values read out from said random access memory and I/O control means connected to receive commands in sequence from said digital processor, said I/O control means being responsive to a first sequence of commands to control the storing of new color values in said random access memory and responsive to a second sequence of commands to read out color values from said random access memory and transmit the read out values to said digital processor, the improvement comprising second control means connected to receive said multibit commands and operating to control said pixel decoder palette in response to a predetermined third sequence of commands including commands of said first sequence and of said second sequence.

12. In a pixel based display system as recited in claim 11 wherein at least one command of said third sequence includes an information byte containing information and wherein said second control means controls said pixel decoder palette in accordance with the information in said information byte.

13. In a pixel decoder system as recited in claim 11, wherein said first sequence comprises a write addressing command for selecting an address location in said palette random access memory for storing of new color followed by three write color commands containing the color values to be stored in the address location selected by the write addressing command, wherein said second sequence comprises a read addressing command for selecting an address location in said palette RAM to be read out followed by three read color commands causing color values to be read from the address location selected by said read addressing command, and wherein said third sequence comprises the following commands in sequence: a first read addressing command containing a predetermined address, first, second and third write color commands containing predetermined data values, a second read address command containing said predetermined address, fourth, fifth and sixth write color commands containing predetermined values, a third read addressing command containing said predetermined address, and seventh and eighth write color commands containing predetermined values.

14. A plug-to-plug compatible pixel decoder palette comprising a palette random access memory having a multiplicity of memory locations, each capable of storing a value representing a color to be displayed, means to receive applied address words in sequence and apply said address words to said palette random access memory to read out said values from said memory locations selected by said address words, means responsive to the values read out from said address memory to generate color video signals for generating a pixel based display in accordance with the values read out from said random access memory, said means to generate analog video signals effecting the display of some pixels bridging boundaries of a displayed objects as mixes of colors on each side of said boundary, wherein said random access memory, said means to receive said address words in sequence, and said means to generate analog signals are integrated into a single integrated circuit chip, said integrated circuit chip including I/O control means for receiving multibit commands transmitted on an I/O channel in sequence and responsive to a first time sequence of said commands to control the storing of new color values in said random access memory, and second control means connected to receive said multibit commands transmitted on said I/O channel and operating to control said integrated circuit chip in response to a plurality of commands in a second time sequence of commands different than said first sequence of commands in accordance with information received in said second sequence of commands.

15. A pixel decoder palette as recited in claim 14, wherein said information is contained in a predetermined byte of said second sequence and wherein said control means controls the operation of said integrated circuit chip in accordance with the information in said predetermined byte.

* * * * *